United States Patent [19]

Spindeler et al.

[11] Patent Number: 4,564,420

[45] Date of Patent: Jan. 14, 1986

[54] COKE OVEN BATTERY

[75] Inventors: Heinrich Spindeler; Folkard Wackerbarth; Horst Kuhlmann; Helmut Dohle; Horst Althaus, all of Bochum, Fed. Rep. of Germany

[73] Assignee: Dr. C. Otto & Comp. GmbH, Bochum, Fed. Rep. of Germany

[21] Appl. No.: 558,020

[22] Filed: Dec. 5, 1983

[30] Foreign Application Priority Data

Dec. 9, 1982 [DE] Fed. Rep. of Germany ..... 3245551

[51] Int. Cl.[4] ..... C10B 5/02; C10B 29/02

[52] U.S. Cl. ..... 202/139; 202/212; 202/223; 202/268

[58] Field of Search ..... 202/139, 212, 223, 267 R, 202/268, 270, 239

[56] References Cited

U.S. PATENT DOCUMENTS 1,150,810 8/1915 Carpenter ..... 202/223

FOREIGN PATENT DOCUMENTS 169080 3/1906 Fed. Rep. of Germany ..... 202/139
294009 9/1916 Fed. Rep. of Germany ..... 202/139
2756330 6/1979 Fed. Rep. of Germany ..... 202/139

*Primary Examiner*—Peter Kratz
*Attorney, Agent, or Firm*—Thomas H. Murray; Clifford A. Poff

[57] ABSTRACT

Coking chambers in a coke oven battery are disposed in an alternate relationship with heating flues. At the top of each coking chamber there is a top arch having an inner-arched surface defined by a segment of a circle whose diameter is greater than the internal width of the coking chamber. The coking chamber is bounded by two heating walls which are extended to the spring of the arch where wall portions extend in an inclined manner upwardly and outwardly to form a mushroom-shaped gas-collecting chamber above the coke oven chamber. These wall portions extend at an angle of approximately 30° to 50° to the horizontal. The diameter of the arched wall portions for the arch is approximately between 30% and 60% greater than the internal width of the coking chamber.

7 Claims, 1 Drawing Figure

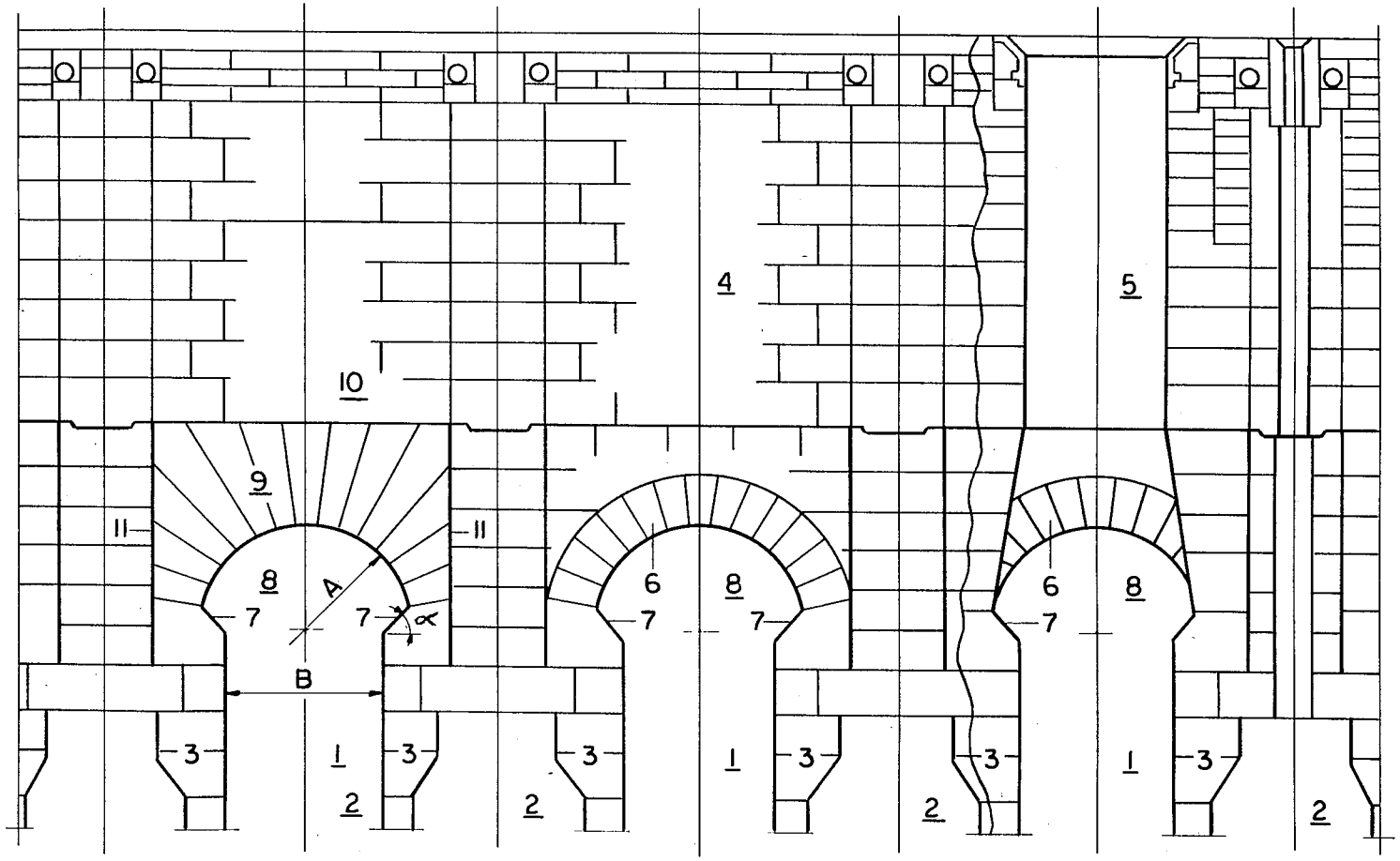
1
2
3
4
5
6
7
8
9
10
11
A
B
α

COKE OVEN BATTERY

BACKGROUND OF THE INVENTION

This invention relates to the arrangement of a top arch for generally rectangular coking chambers disposed in an alternate relationship with heating flues which, like the coking chambers, extend transversely of the length of a coke oven battery. The coking chambers are bounded by vertical heating walls that separate the heating flues from the coking chambers.

Coal for the coking process is charged into the various coking chambers through a number of charging openings in the oven crown. The charging openings are distributed over the length of the coking chambers. A gas-collecting chamber is formed above the coal charge by maintaining a space in the coking chamber between the coal charge and the coking chamber roof. A leveling rod is usually introduced from the coke machine side of the coke oven battery into the gas-collecting chamber for leveling the coal charge.

As disclosed in West German patent specification No. 503 814, it is known in the art to provide the top ends of the coking chambers with a semicircular arching or vaulting so that a gas-collecting chamber is formed with a semicircular cross section.

The development of a high-performance coke oven battery having relatively wide coking chambers has led to problems in the construction of the oven crown. The oven crown must withstand the forces produced by heavy charging trucks moving along the top of the oven crown. At the same time, the cross sections of the gas-collecting chambers at the tops of the oven chambers must not be reduced in order that the gases evolving during the distillation process can be discharged satisfactory from the coking chambers.

SUMMARY OF THE INVENTION

It is an object of the present invention to solve the problem of constructing oven crowns for coking chambers in a coke oven battery in a manner such that the oven crowns can withstand the forces imposed by the weight of heavy trucks and, at the same time, insure that the gas-collecting chambers above the coal charge in coking chambers are of adequate size for discharging the gases evolving during the coking process.

It is another object of the present invention to provide a coke oven battery including coking chambers each of which has a rectangular cross section and a top arch which is sprung from the top of heating walls for the coking chamber wherein the top arch includes an inner-arched surface defined by a segment of a circle, the diameter of which is greater than the internal width of the coking chamber and forms a gas-collecting chamber having, in cross section, a shape resembling a mushroom.

More particularly, according to the present invention there is provided a coke oven battery including a plurality of coking chambers disposed in an alternate relationship with heating flues which, like the coking chambers, extend transversely of the length of the coke oven battery, the heating flues being bounded by vertical heating walls separating the coking chambers from the heating flues, each coking chamber having a generally rectangular cross section and a top arch forming a mushroom-shaped gas-collecting chamber at the top of the coking chamber, the top arch being sprung from the top of the heating walls for the coking chamber and having an iner-arched surface defined by a segment of a circle whose diameter is greater than the internal width of the coking chamber, the arch including arched wall portions above the two heating walls bounding the coking chambers and extending to the spring of the arch, the arched wall portions having wall surfaces extending in an upwardly- and outwardly-inclined manner to widen the width of the coking chamber at the joint with the inner surface of the arch to thereby form the mushroom-shaped gas-collecting chamber.

Preferably, according to the present invention the wall surfaces of the arched wall portions extend at an angle to the horizontal which is approximately within the range of 0° to 75°, preferably 30° to 50°. The diameter of the inner-arched surface which forms a segment of the circle is approximately between 30% and 60% greater than the internal width of the coking chamber. Preferably, the bricks forming the arch extend laterally to expansion joints and upwardly to a sliding joint.

Thus, it can be seen that the gas-collecting chamber extends beyond the width of the coke oven chamber into the zone of the heating walls. The cross-sectional area of the gas-collecting space at the top of the coal charge is increased to insure improved discharge of gases from the oven chambers during filling and leveling operations. Moreover, the inclined wall surfaces of the arched wall portions can be used to guide apparatus for supporting the leveing rod.

These features and advantages of the present invention as well as others will be more fully understood when the following description is read in light of the accompanying single FIGURE drawing wherein there is illustrated a longitudinal section, in elevation, through part of a coke oven battery.

In the drawing, three coking chambers 1 are disposed in a manner, per se, known in the art in an alternate arrangement with heating flues 2. Heating walls 3 separate the coking chambers from the heating flues. Above the coking chambers 1 is a masonry oven crown or roof 4. A charging truck, not shown, can move along the roof for charging coking coal into the oven chambers. A charging opening 5 is shown for the oven chamber at the right as one views the drawing for delivering coking coal from the charging truck into the oven chamber.

According to the present invention, the various coking chambers 1, which have a rectangular cross section, each includes an arch 6 having the form of a segment of a circle whose diameter A is greater than the internal width B of the associated coking chamber.

According to a further feature of the present invention, near the spring of the arch, the two heating walls bounding the coking chamber are extended and provided with an increased width that extends to the large diameter of the arch. For this purpose, as illustrated in the drawing, bricks forming wall portions 7 are formed with face surfaces that are inclined upwardly and outwardly in a manner which forms a mushroom-shaped gas-collecting chamber 8 above each coking chamber. The wall surfaces of wall protions 7 are inclined at an angle $\alpha$ of approximately between 30° and 50° to the horizontal.

The arch for the coking chamber shown at the left-side of the drawing, includes specially-shaped bricks 9. Some of the bricks 9 extend laterally in a generally horizontal direction from the circular segment of the arch to a lateral expansion joint 11 while other bricks extend in a generally vertical direction from the circular segment of the arch to a sliding joint 10.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A coke oven battery including a plurality of coking chambers disposed in an alternate relationship with heating flues which, like the coking chambers, extend transversely of the length of the coke oven battery, the heating flues being bounded by vertical heating walls separating the coking chambers from the heating flues, each coking chamber having a generally rectangular cross section, and a top arch above each coking chamber forming a mushroom-shaped gas-collecting chamber extending along the top of the coking chamber, said top arch being sprung from the top of the heating walls for the coking chamber and having an inner-arched surface defined by a segment of a circle whose diameter is greater than the internal width of the coking chamber, said arch including arched wall portions above the two heating walls bounding the coking chamber and extending to the spring of the arch, said arched wall portions having wall surfaces extending in an upwardly- and outwardly-inclined manner to define a width of the gas-collecting chamber which is wider than the width of the coking chamber at the joint with said inner-arched surface to thereby form said mushroom-shaped gas-collecting chamber.

2. The coke oven battery according to claim 1 wherein the wall surfaces of said arched wall portions form an angle $\alpha$ to the horizontal, the angle $\alpha$ being approximately within the range of 0° to 75°.

3. The coke oven battery according to claim 1 wherein the wall surfaces of said arched wall portions form an angle $\alpha$ to the horizontal, the angle $\alpha$ being approximately within the range of 30° to 50°.

4. The coke oven battery according to claim 1 wherein said segment of the circle defining the inner-arched surface of the top arch is within the range of 30% to 60% greater than the internal width of the coking chamber.

5. The coke oven battery according to claim 1 wherein said top arch further includes bricks having a face surface forming said inner-arched surface and having an extended length to form lateral expansion joints.

6. The coke oven battery according to claim 1 wherein said top arch further includes bricks having a face surface forming said inner-arched surface and having an extended length to form lateral sliding joints.

7. The coke oven battery according to claim 1 wherein said wall surfaces extending in an upwardly- and outwardly-inclined manner guide a leveling rod means.

* * * * *